US007139498B2

(12) United States Patent
Mashiba et al.

(10) Patent No.: US 7,139,498 B2
(45) Date of Patent: Nov. 21, 2006

(54) IMAGE FORMING APPARATUS HAVING TRANSFER BIAS VOLTAGE

(75) Inventors: Tamaki Mashiba, Nara (JP); Masashi Hirai, Katano (JP); Shigeru Watase, Hashimoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 257 days.

(21) Appl. No.: 10/766,099

(22) Filed: Jan. 27, 2004

(65) Prior Publication Data

US 2004/0202488 A1 Oct. 14, 2004

(30) Foreign Application Priority Data

Jan. 28, 2003 (JP) ..... P2003-018898

(51) Int. Cl.
*G03G 15/16* (2006.01)

(52) U.S. Cl. ..... 399/66; 399/299

(58) Field of Classification Search ..... None
See application file for complete search history.

(56) References Cited

U.S. PATENT DOCUMENTS 5,600,421 A * 2/1997 Takekoshi et al. ..... 399/66
5,930,556 A * 7/1999 Imamiya ..... 399/66
6,021,287 A * 2/2000 Tanaka ..... 399/66
6,148,159 A * 11/2000 Shiraishi ..... 399/44
6,442,356 B1 * 8/2002 Omata et al. ..... 399/66
6,600,894 B1 * 7/2003 Takahashi et al. ..... 399/303

FOREIGN PATENT DOCUMENTS

| | | |
|---|---|---|
| JP | 02-039181 | 2/1990 |
| JP | 05-150577 | 6/1993 |
| JP | 07-020727 | 1/1995 |
| JP | 07-181814 | 7/1995 |
| JP | 10-142893 | 5/1998 |

* cited by examiner

*Primary Examiner*—Robert Beatty
(74) *Attorney, Agent, or Firm*—George W. Neuner; David G. Conlin; Edwards Angell Palmer & Dodge LLP

(57) ABSTRACT

A tandem-type image forming apparatus for forming a multi-color image on a sheet transported by an endless transfer/transport belt, by sequentially laying on the sheet images developed in respective image forming stations. The apparatus includes: transfer rollers, each in contact through the transfer/transport belt with an image carrier provided in each image forming station; and a voltage applying device for applying a non-transfer bias voltage to only the transfer rollers that are in contact with the image carriers when a transfer process is not performed, the non-transfer bias voltage having the same polarity as a transfer bias voltage and being lower than the transfer bias voltage.

3 Claims, 8 Drawing Sheets

+
0
−
d
t

+
0
−
-500 V (~-700 V)

(+1.5 V~+4 kV)
+
+300 V (+200 V~+300 V)
K-TC
0
−
D (+1.5 V~+4 kV)
+
+100 V (+50 V~+200 V)
C-TC
0
−
D (+1.5 V~+4 kV)
+
+100 V (+50 V~+200 V)
M-TC
0
−
D (+1.5 V~+4 kV)
+
+100 V (+50 V ~ +200 V)
Y-TC
0
−

| ELECTRIC POTENTIAL OF PHOTOSENSITIVE DRUM | NON-TRANSFER BIAS VOLTAGE TO TRANSFER ROLLER 6a (TC - K) | | NON-TRANSFER BIAS VOLTAGE TO TRANSFER ROLLERS 6b,6c,6d |
|---|---|---|---|
| | 117mm/s | 39mm/s | INDEPENDENT OF SPEED |
| ~ -450 V | +300 V | +225 V | +50 V |
| -450 V ~ -550 V | | | +100 V |
| -550 V ~ -650 V | | | +150 V |
| -650 V ~ -700 V | | | +200 V |

FIG. 7

IMAGE FORMING APPARATUS HAVING TRANSFER BIAS VOLTAGE

CROSS REFERENCE

This Nonprovisional application claims priority under 35 U.S.C. § 119(a) on Patent Application No. 2003-018898 filed in Japan on Jan. 28, 2003, the entire contents of which are hereby incorporated by reference.

BACKGROUND OF THE INVENTION

The present invention relates to an electrophotographic image forming apparatus including a plurality of image forming stations.

An electrophotographic image forming process includes a transfer process in which a developed image formed with developer (hereinafter referred to as a developer image) on a surface of an image carrier is transferred to a sheet material transported near the image carrier.

In the transfer process, a transfer bias voltage is generally applied to a transfer electrode which is in contact with a surface of the sheet material, the surface being a reverse side with no image to be formed thereon. Typical examples of the transfer electrode are a transfer roller and a transfer/transport belt. The transfer bias voltage is typically from about +1.5 kV to +4 kV of opposite polarity to the developer.

The transfer bias voltage is usually opposite in polarity to an electric potential of the image carrier. There is thus possibility of the surface of the image carrier being irregularly charged by contact with the transfer electrode where the transfer bias voltage is applied. The irregular charging of the image carrier occurs more likely when there is no sheet material between the transfer electrode and the image carrier and thus the transfer electrode are in direct contact with the image carrier.

This is why some conventional image forming apparatuses have utilized a control method by which a transfer bias voltage is applied to a transfer electrode in a timely manner when a sheet material is transported in between an image carrier and the transfer electrode.

However, it is hard to apply the transfer bias voltage to the transfer electrode in accurate timing with transportation of a sheet material. A slight delay in applying the transfer bias voltage causes the fact that a developer image is not transferred to a front portion of a sheet material. If the transfer bias voltage is applied untimely, the image carrier is charged irregularly, causing image quality deterioration.

In the aforementioned method, moreover, the transfer bias voltage is not applied to the transfer electrode when there is no sheet material between the image carrier and the transfer electrode. Accordingly, the transfer electrode can be negatively charged under the influence of the image carrier having a negative charge. This results in the problem that the transfer electrode cannot be charged appropriately even though the transfer bias voltage is applied thereto.

Thus, in some conventional art methods, when there is no sheet material between an image carrier and a transfer electrode, a voltage of the same polarity as the transfer bias voltage is applied to the transfer electrode, the voltage being very low compared to the transfer bias voltage. The conventional art argues that it can prevent the transfer electrode from being negatively charged while the transfer process is not performed, thereby allowing appropriate application of the transfer bias voltage in the transfer process. The conventional art also argues that it can prevent irregular charging of the image carrier and the transfer electrode even when they are in direct contact with each other.

The foregoing method for controlling the transfer bias voltage is disclosed in JP H02-39181 A (see line 11, upper right column on page 3, to line 8, upper left column on page 4, and FIG. 3), JP H05-150577 A (see paragraphs [0021] to [0023], FIGS. 1 and 2), and JP H10-142893 A (see paragraphs [0044] to [0047], FIG. 1), for example. A power unit for controlling the transfer bias voltage as described above is disclosed in JP H07-181814 A and JP H07-20727 A, for example.

However, in a tandem-type image forming apparatus provided with a plurality of image forming stations, the aforementioned method for controlling the transfer bias voltage sometimes cannot be utilized appropriately. As a typical example of the tandem-type image forming apparatus, let us consider here an image forming apparatus for forming a multi-color image on a sheet material transported by a transfer electrode provided in endless form, by sequentialy transferring onto the sheet material developer images formed in the respective image forming stations.

In this tandem-type image forming apparatus, if the aforementioned method for controlling the transfer bias voltage is used in the image forming stations, the voltage is sequentially applied to the transfer electrode when the transfer process is not performed. Thus, a positive potential of the transfer electrode increases to a higher level than necessary. This causes excessive amount of developer to be transferred to the transfer electrode, resulting in problems such as image quality deterioration and developer wastage. It also causes irregular charging of the image carrier that is in contact with the transfer electrode.

BRIEF SUMMARY OF THE INVENTION

It is an object of the present invention to provide a tandem-type image forming apparatus capable of maintaining a transfer electrode and an image carrier in appropriate charged state without using a complicated regulation process.

To accomplish the object, the image forming apparatus of the present invention includes:

image forming stations arranged along a sheet transport path, each having an image carrier;

a transfer/transport belt for holding and transporting downstream in a sheet transport direction a sheet for an image to be formed thereon by the image forming stations;

transfer electrodes in contact through the transfer/transport belt with the image carriers provided in the image forming stations; and a voltage applying device for applying a voltage to the transfer electrodes, wherein the voltage applying device, when a transfer process is not performed, applies a non-transfer bias voltage to only the transfer electrodes in contact with the image carriers, the non-transfer bias voltage having the same polarity as a transfer bias voltage and being lower than the transfer bias voltage.

The non-transfer bias voltage, having the same polarity as the transfer bias voltage, is lower by about 90% to about 98% than the transfer bias voltage. The non-transfer bias voltage is not applied to transfer electrodes that are not in contact with the image carriers when the transfer process is not performed.

The voltage applying device applies a higher non-transfer bias voltage to a first transfer electrode positioned upstream with reference to the sheet transport direction than to the other transfer electrodes.

More specifically, when there is a plurality of transfer electrodes in contact with the image carriers and the transfer process is not performed, a higher non-transfer bias voltage is not applied to the other transfer electrodes than the transfer bias voltage applied to the first transfer electrode positioned upstream with reference to the sheet transport direction.

This prevents the transfer/transport belt from being excessively charged, thus preventing image quality deterioration and developer wastage.

In the present invention, moreover, the non-transfer bias voltage can be adjusted in accordance with the electrical charge of the image carriers, temperature and humidity around the transfer/transport belt, and rotational speed of the image carriers.

BRIEF DESCRIPTION OF THE DRAWINGS

FIG. 7 is a table illustrating the relationship between rotational speed and electric potential of the image forming apparatus, and non-transfer bias voltage.

DETAILED DESCRIPTION OF THE INVENTION

As an embodiment of the present invention, a tandem-type digital multi-color image forming apparatus (hereinafter referred to as the image forming apparatus) is described below with reference to the accompanying drawings.

Figure 1:
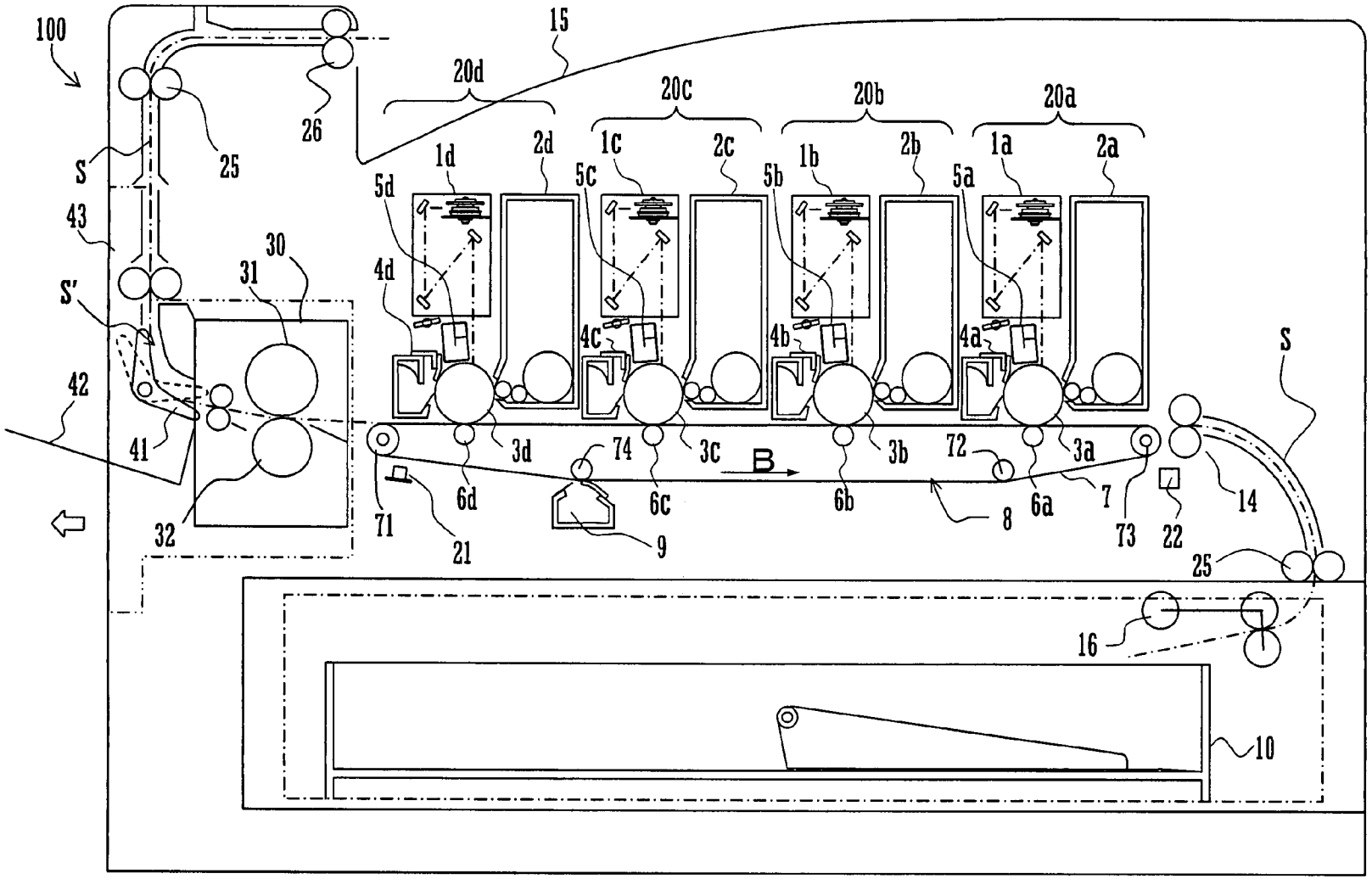
FIG. 1 is a configuration diagram of the image forming apparatus according to an embodiment of the present invention.

FIG. 1 illustrates configuration of an image forming apparatus 100. The image forming apparatus 100 forms a multi-color or monochromatic image on a sheet (including a non-paper sheet material as well as paper) in accordance with image data supplied externally.

The image forming apparatus 100 is provided with a sheet transport path S leading from a sheet feed tray 10 for storing sheets therein to a sheet eject roller 26 for ejecting a sheet. The sheet transport path S is positioned in the center of the image forming apparatus 100. Across the sheet transport path S, four image forming stations 20 (20*a* to 20*d*) and a transfer/transport belt unit 8 are arranged to face each other. The four image forming stations 20 are respectively provided for performing image forming process with respect to color elements of black (K), cyan (C), magenta (M), and yellow (Y). The transfer/transport belt unit 8 is provided for holding and transporting downstream in the sheet transport path S a sheet onto which the image forming process is to be performed. Besides, a fixing device 30 is arranged downstream of the image forming stations 20 in the sheet transport path S.

In the image forming stations 20 (20*a* to 20*d*), photosensitive drums 3 (3*a* to 3*d*) as image carriers are arranged in such a manner as to be in contact with the sheet transport path S. Provided around the photosensitive drums 3 are exposure units 1 (1*a* to 1*d*), developing devices 2 (2*a* to 2*d*), charging devices 5, and cleaning units 4 (4*a* to 4*d*).

The charging devices 5 are provided for applying an electrostatic charge uniformly over the surfaces of the photosensitive drums 3. Although the charging devices 5 in the present embodiment are charger-type devices, a contact-type charging device in roller form or brush form may be used as the charging devices 5. The exposure units 1 are used for forming an electrostatic latent image by exposing the surface of the photosensitive drums 3 in accordance with provided image data. Used as the exposure units 1 is a laser scanning unit (LSU) including a laser radiation portion and reflecting mirrors. Alternatively, a writing head provided with an array of light emitting elements, such as an EL or LED array, may be used as the exposure units 1.

The developing devices 2 are used for developing an electrostatic latent image formed on the photosensitive drums 3 into a visible image with toner of the color elements black (K), cyan (C), magenta (M), and yellow (Y). The cleaning units 4 are used for removing and capturing toner remaining on the surface of the photosensitive drums 3 after the transfer process.

The transfer/transport belt unit 8 is arranged to face the photosensitive drums 3 (3*a* to 3*d*) of the respective image forming stations 20 (20*a* to 20*d*) across the sheet transport path S. The transfer/transport belt unit 8 includes a transfer/transport belt 7, a transfer belt drive roller 71, a transfer belt tension roller 72, a transfer belt driven roller 73, a transfer belt support roller 74, transfer rollers 6 (6*a* to 6*d*), and a transfer belt cleaning unit 9.

Under normal operation, the transfer belt drive roller 71, the transfer belt tension roller 72, the transfer rollers 6, the transfer belt driven roller 73, and the transfer belt support roller 74 are driven counterclockwise in FIG. 1, causing the transfer/transport belt 7 installed over these rollers to rotate in the direction of arrow B. The transfer rollers 6, rotatably mounted on an inner frame (not shown) of the transfer/transport belt unit 8, are used for transferring toner images formed on the photosensitive drums 3 onto a sheet on the transfer/transport belt 7.

The transfer/transport belt 7 is arranged in such a manner as to be in contact with the photosensitive drums 3 of the respective image forming stations 20 (20*a* to 20*d*). The transfer/transport belt 7 is made into endless form by using a film of a thickness of about 100 μm to 150 μm. Volume resistivity of the transfer/transport belt 7 is approximately $10^{10}$ to $10^{12}$ Ω-cm.

The transfer rollers 6*b*, 6*c*, and 6*d* are respectively arranged so as to be able to be moved close to, or away from, the photosensitive drums 3*b*, 3*c*, and 3*d*. In multi-color image forming process, the transfer rollers 6*b*, 6*c*, and 6*d* are in contact with the photosensitive drums 3*b*, 3*c*, and 3*d*, as illustrated by a dashed line in FIG. 2. In monochromatic image forming process, the transfer rollers 6*b*, 6*c*, and 6*d* are kept away from the photosensitive drums 3*b*, 3*c*, and 3*d*, as illustrated by a solid line. As the transfer rollers 6*b*, 6*c*, and 6*d* move, the transfer belt drive roller 71 and the transfer belt support roller 74 also move.

Provided under the transfer/transport belt 7 is an image quality sensor 21. The image quality sensor 21 is provided for measuring image density of a testing pattern formed on the transfer/transport belt 7 for image adjustment. The measurement result of the image quality sensor 21 is used for regulating conditions for image forming process by the image forming apparatus 100. The conditions for image forming process are, for example, surface potential of the photosensitive drums 3, a developing bias voltage, a transfer bias voltage, laser diode light source power, etc.

Transfer of toner images from the photosensitive drums 3 onto a sheet is performed by the transfer rollers 6 which are in contact with a backside of the transfer/transport belt 7. A transfer bias voltage is applied to the transfer rollers 6 for the transfer of toner images. In the present embodiment, since toner is negatively charged, the transfer bias voltage is positive, opposite to the charge of the toner. Each of the transfer rollers 6 has at the center thereof a metal (e.g. stainless steel) shaft with a diameter of about 8 to about 10 mm, the surface of the shaft being coated with a conductive elastic material such as EPDM or foam urethane. The conductive elastic material allows uniform application of the high voltage to the sheet.

Since toner which adheres to the transfer/transport belt 7 by contact with the photosensitive drums 3 may contaminate a reverse side of a sheet, the toner is removed and captured by the transfer belt cleaning unit 9. The transfer belt cleaning unit 9 is provided with a cleaning blade arranged to be in contact with the transfer/transport belt 7. The transfer belt support roller 74 is placed to face the cleaning blade across the transfer/transport belt 7.

The sheet feed tray 10 is provided below an image forming section of the image forming apparatus 100, for storing sheets to which the image forming process is to be performed. A sheet eject tray 15 is provided on top of the image forming apparatus 100, for placing a printed sheet face down. Additionally, a sheet eject tray 42 is provided on a lateral part of the image forming apparatus 100, for placing face up a sheet with images formed thereon.

Along the sheet transport path S formed in the shape of the letter S, a pick-up roller 16, registration rollers 14, the fixing device 30, and a transport direction switching gate 41 are arranged in order of sheet transport flow from upstream to downstream, as shown in FIG. 1. Also, a plurality of transport rollers 25 are arranged at several points along the sheet transport path S.

The transport rollers 25 are small rollers for facilitating and assisting sheet transport. The pick-up roller 16 is provided at an end part of the sheet feed tray 10, for picking up only a sheet situated on top of sheets stored in the sheet feed tray 10 and then putting the sheet on the sheet transport path S.

The transport direction switching gate 41, rotatably mounted on a side cover 43 of the image forming apparatus 100, is moved as necessary between two states illustrated by solid and dashed lines. In the state as illustrated by the dashed line in FIG. 2, the transport direction switching gate 41 makes a sheet depart from the sheet transport path S to be ejected into the sheet eject tray 42. In the state as illustrated by the solid line in FIG. 2, the transport direction switching gate 41 makes a sheet go through a paper transport section S' surrounded by the fixing device 30, the side cover 43, and the transport direction switching gate 41, with a result that the sheet is ejected into the sheet eject tray 15 located on top of the image forming apparatus 100.

The registration rollers 14 have a function of temporarily holding a sheet which is being transported on the sheet transport path S, in order to regulate sheet transport timing in the sheet transport path S. The registration rollers 14 determine the sheet transport timing in accordance with an output signal from a detection switch (not shown).

Provided near the transfer/transport belt unit 8 is a temperature/humidity sensor 22 for checking internal environment conditions of the image forming apparatus 100. The temperature/humidity sensor 22 detects internal temperature and humidity of the image forming apparatus 100. The detection result of the sensor 22 is used in regulating conditions for image forming process by the image forming stations 20.

Figure 2:
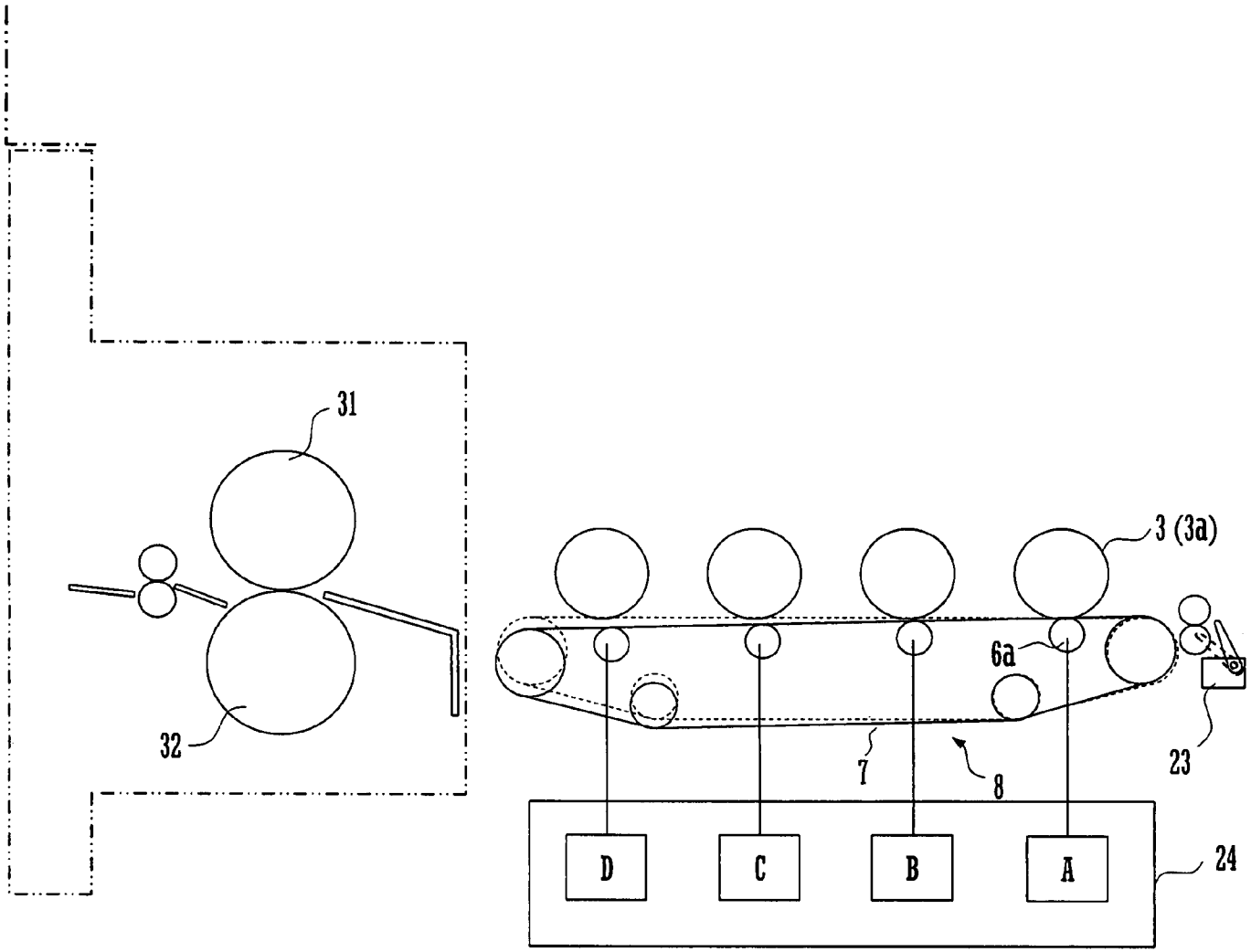
FIG. 2 is a diagram illustrating configuration around a transfer belt.

Regulation of transfer bias voltage is now described in detail below. Illustrated in FIG. 2 is configuration around the transfer/transport belt 7. A transfer power supply unit 24 is provided near the transfer/transport belt unit 8. The transfer power supply unit 24 (voltage applying device) includes transfer power supplies A, B, C, and D. The transfer power supplies A, B, C, and D are respectively connected to the transfer rollers 6*a*, 6*b*, 6*c*, and 6*d*, for applying voltages including a transfer bias voltage and a non-transfer bias voltage to the transfer rollers 6*a*, 6*b*, 6*c*, and 6*d*.

Figure 3:
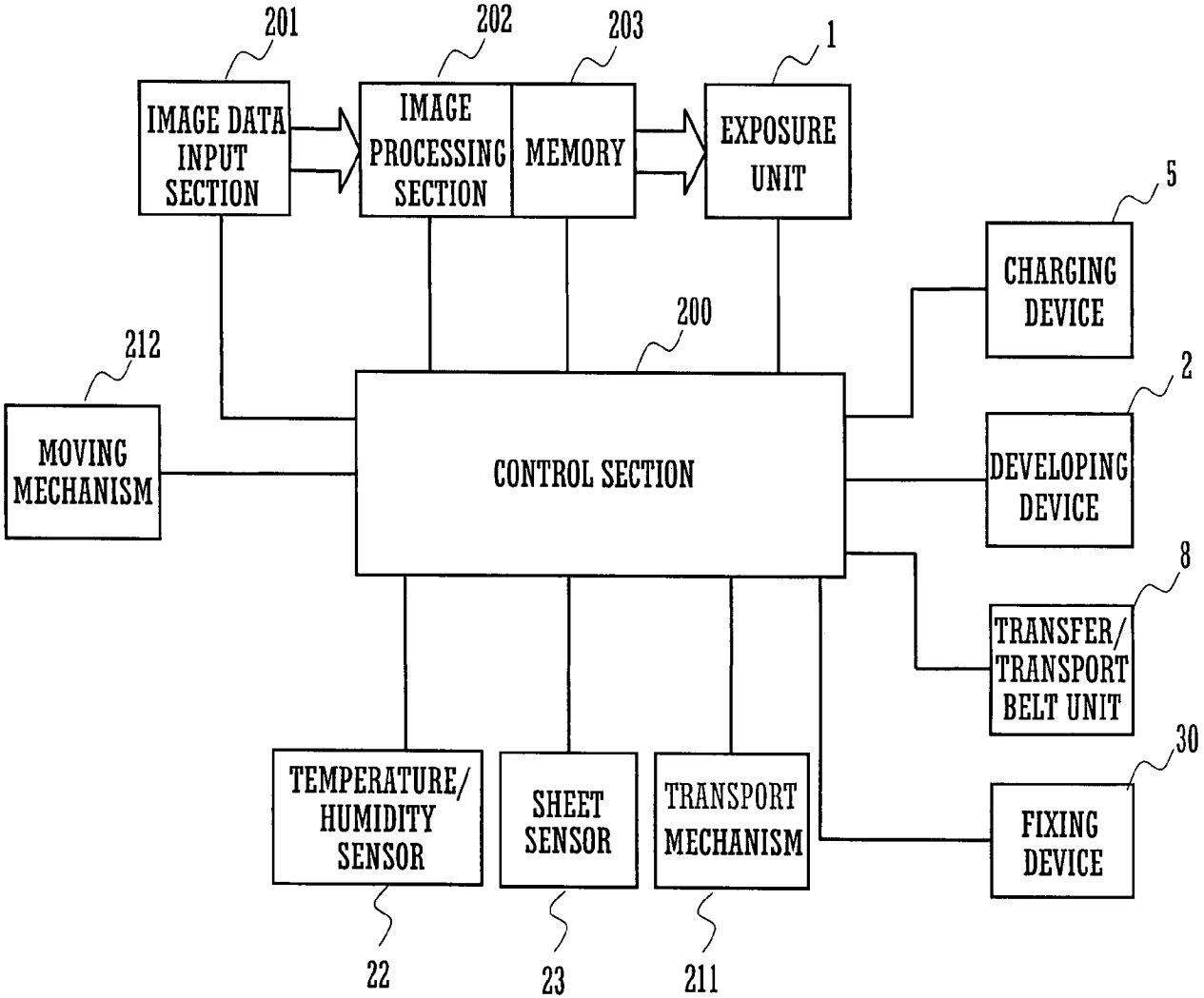
FIG. 3 is a block diagram illustrating schematic configuration of the image forming apparatus.

FIG. 3 is a block diagram illustrating schematic configuration of the image forming apparatus 100. The image forming apparatus 100 is provided with a control section 200 including CPU, ROM, and RAM.

The control section 200 is connected to an image data input section 201, a sheet sensor 23, the temperature/humidity sensor 22, an image processing section 202, a memory 203, the exposure units 1, the charging devices 5, the developing devices 2, the transfer/transport belt unit 8, the fixing device 30, a transport mechanism 211, and a moving mechanism 212.

The moving mechanism 212 moves the transfer/transport belt 7 close to, or away from, the photosensitive drums 3*b* to 3*d*. The transfer/transport belt unit 8 includes the transfer/transport belt 7, the transfer rollers 6*a* to 6*d*, and the transfer power supply unit 24.

In the present embodiment, a transfer bias voltage and a non-transfer bias voltage are selectively applied from the transfer power supply unit 24 to the transfer rollers 6*a* to 6*d*. The transfer bias voltage is applied when developer images formed on the photosensitive drums 3*a* to 3*d* are transferred onto a sheet. In contrast, the non-transfer bias voltage is applied for stabilization of the transfer bias voltage when there is no sheet between the transfer/transport belt 7 and the photosensitive drums 3*a* to 3*d*.

Each of the transfer power supplies A, B, C, and D includes a high-voltage transformer, a primary driver circuit, and a PWM oscillator. Value of voltage to be supplied from the transfer power supplies A, B, C, and D to the transfer rollers 6*a* to 6*d* is regulated by the PWM oscillator. In the present embodiment, a primary voltage is supplied by a main power supply of the image forming apparatus 100, namely, a 24V DC power supply. The primary voltage is transformed by the high-voltage transformer to a secondary voltage ranging from about 0V to about 4V. The secondary voltage is supplied to the transfer rollers 6.

The transfer power supplies A, B, C, and D are respectively connected to the transfer rollers 6*a*, 6*b*, 6*c*, and 6*d*, so that voltages to be applied to the transfer rollers 6*a* to 6*d* can be regulated individually.

The transfer bias voltage (TC) is set to an optimum value depending on the internal temperature and humidity of the image forming apparatus 100, rate of deterioration of the photosensitive drums 3 and developer, kind of sheet in use. Although the transfer bias voltage (TC) is set from about +1.5 kV to about +4 kV, the transfer bias voltage (TC) also depends on a level to which the photosensitive drums 3 are charged.

Figure 4:
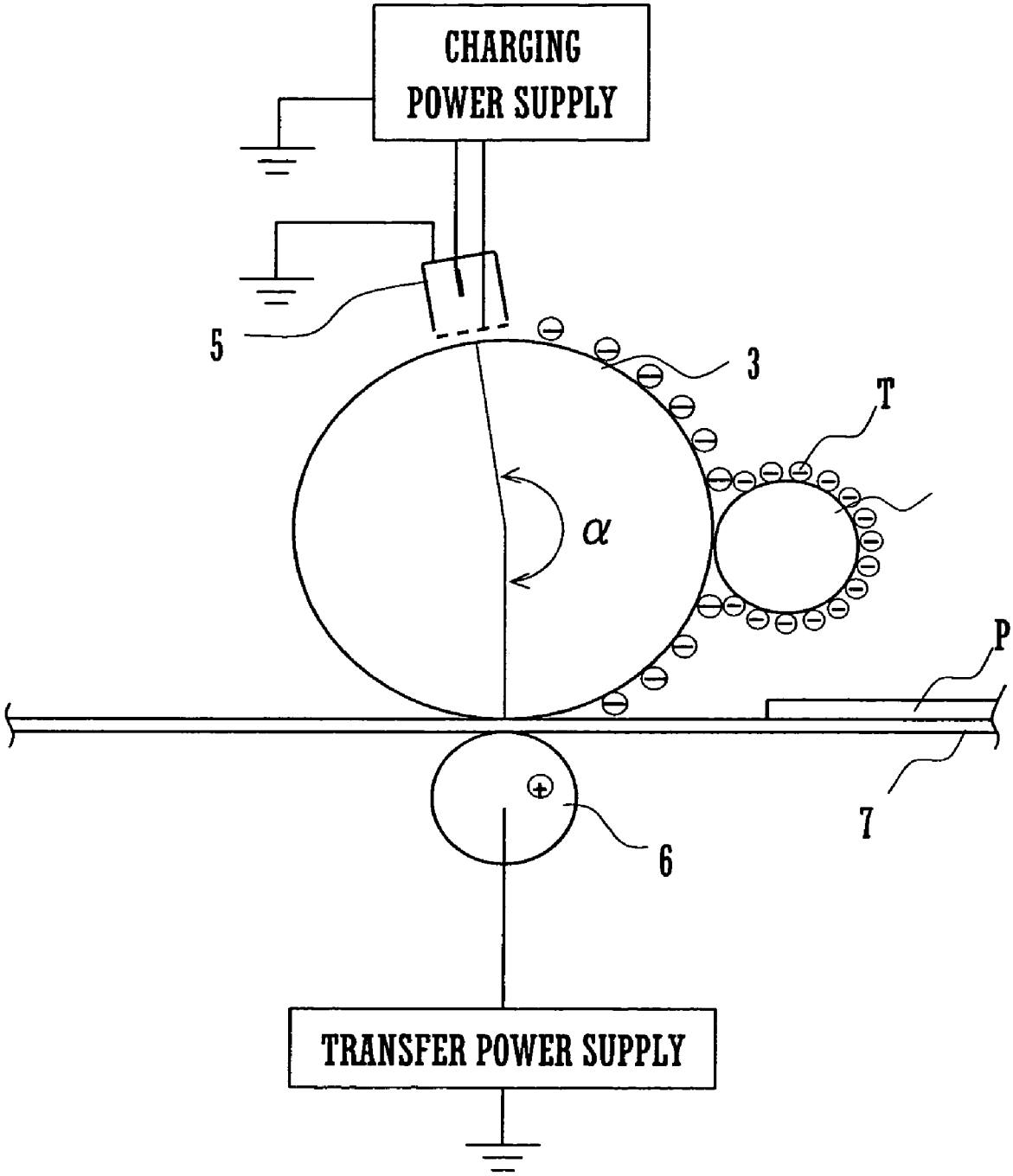
FIG. 4 is a diagram illustrating a photosensitive drum as charged.

FIG. 4 illustrates one of the photosensitive drums 3, as charged. Each of the charging devices 5 provided for charging the surface of the photosensitive drums 3 is connected to its corresponding charging power supply. In image forming process, the charging devices 5 apply a negative charging bias voltage to the surface of the photosensitive drums 3, so that the surface of the photosensitive drums 3 is negatively charged. Developing rollers in the developing devices 2 as well as the developer are also negatively charged.

This causes the transfer rollers 6 to be easily charged negatively, since the transfer rollers 6 are in direct contact with the negatively-charged photosensitive drums 3 when there is no sheet between the photosensitive drums 3 and the transfer/transport belt 7.

Figures 5A, 5B, 5C:
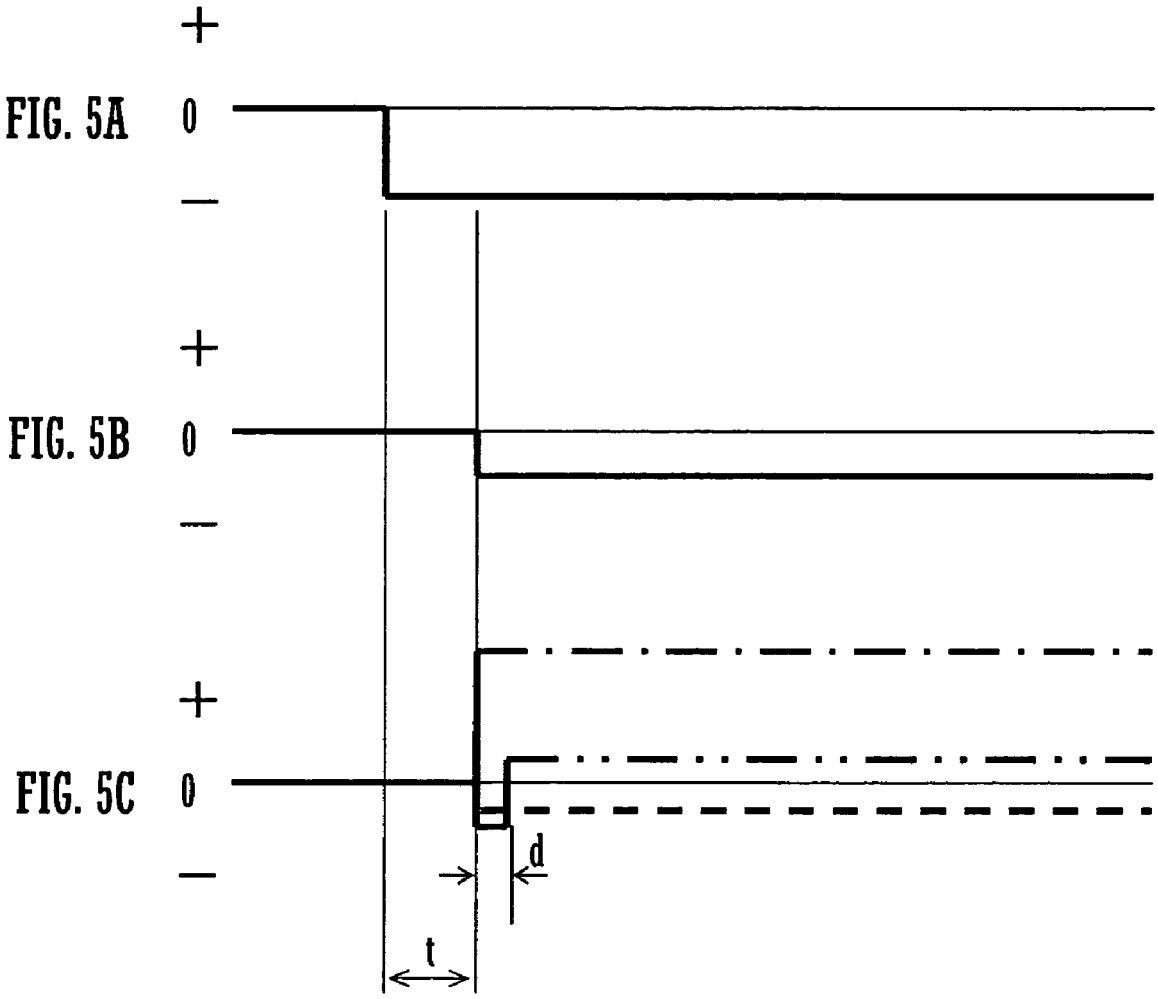
FIGS. 5A to 5C are diagrams illustrating change in electric potential of a transfer roller.

The above-mentioned problem is now described with reference to FIGS. 5A, 5B, and 5C. FIGS. 5A, 5B, and 5C illustrate change in electric potential of one of the transfer rollers 6. FIG. 5A shows electric potential of one of the photosensitive drums 3. FIG. 5B shows electric potential of one of the transfer rollers 6 with no voltage supplied thereto. FIG. 5C shows electric potential of the same transfer roller 6 with a transfer bias voltage supplied thereto. As shown in FIGS. 5A to 5C, when the charging bias voltage is applied to the photosensitive drum 3, a negatively-charged portion on the photosensitive drum 3 becomes in contact with the transfer roller 6 in t seconds. The time t herein is time that it takes the photosensitive drum 3 to rotate by angle a as in FIG. 4.

It is necessary that the transfer roller 6 be charged to have electric potential (from about +1.5 kV to about +4 kV) as shown by a dotted-dashed line, in t seconds after the application of the charging bias voltage. However, the negatively charged photosensitive drums 3 cause the transfer rollers 6 to have electric potential as shown by a double-dotted-dashed line. This is because under the influence of the negatively charged photosensitive drum 3 the transfer roller 6 cannot be charged appropriately even when the transfer bias voltage is applied thereto, so that rise in electric potential of the transfer roller 6 is delayed by time d. The delay causes the fact that a developer image is not appropriately transferred to a front portion of a sheet.

In order to solve problems such as the delayed rise and insufficiency of electric potential, the non-transfer bias voltage is applied to the transfer roller 6 when the transfer process is not performed in the present embodiment. The non-transfer bias voltage, having the same polarity as the transfer bias voltage, is much lower than the transfer bias voltage. The non-transfer bias voltage is regulated within a range of about +50V to about +300V. The non-transfer bias voltage is determined according to a table storing rules for determining voltages based on conditions such as photosensitivity of the photosensitive drum 3 and internal environment of the image forming apparatus 100.

Figures 6A, 6B, 6C, 6D, 6E:
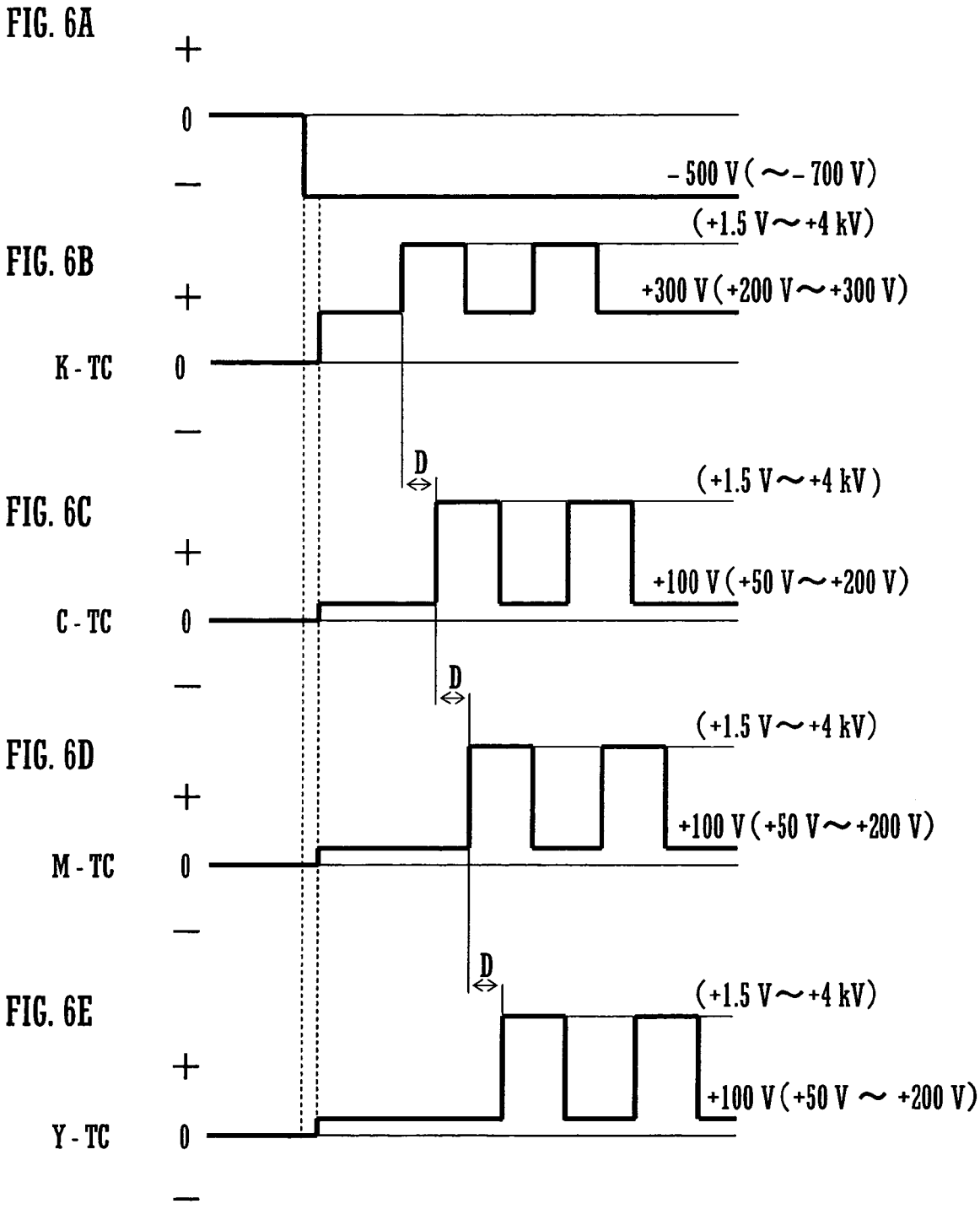
FIGS. 6A to 6E are diagrams illustrating electric potentials of the image carriers and the transfer rollers.

FIG. 6A illustrates electric potential of one of the photosensitive drums 3, and FIGS. 6B to 6E illustrate electric potential of the transfer rollers 6*a* to 6*d*, respectively. With the surface potential of the photosensitive drum 3 ranging from about −500 V to about −700 V, the non-transfer bias voltage of about +300V is applied to the transfer roller 6*a* provided for transferring a black (K) developer image. It is possible to change the non-transfer bias voltage appropriately within a range of about +200V and about +300V.

In transferring the developer image onto a first sheet, the transfer bias voltage of about +1.5 kV to about +4 kV is applied to the transfer roller 6*a*. The non-transfer bias voltage is subsequently applied to the transfer roller 6*a* during an interval between the first sheet and a second sheet. Similarly, the transfer bias voltage is applied to the transfer roller 6*a* again in transferring the developer image onto the second sheet, and after passage of the second sheet the non-transfer bias voltage is applied to the transfer roller 6*a*.

Similar regulation of the transfer and non-transfer bias voltages is performed with regard to the transfer roller 6*b* provided for transferring a cyan (C) developer image. The non-transfer bias voltage applied to the transfer roller 6*b* is about +100V, lower than that applied to the transfer roller 6*a*. It is possible to adjust the non-transfer bias voltage to be applied to the transfer roller 6*b*, within a range of about +50V and about +200V. The application of the transfer bias voltage to the transfer roller 6*b* is delayed by time D from the application of the transfer bias voltage to the transfer roller 6*a*.

The same regulation of the transfer and non-transfer bias voltages as in the transfer roller 6*b* is performed with regard to the transfer rollers 6*c* and 6*d* provided for transferring magenta (M) and yellow (Y) developer images, respectively. Although in this embodiment a case is described in which image forming process is performed onto two consecutive sheets, the present invention is applicable to image forming process onto more than three consecutive sheets, as well as onto a single sheet.

In this embodiment, as described above, the non-transfer bias voltage applied to the transfer rollers 6*b*, 6*c*, and 6*d* located downstream in the sheet transport direction is regulated to be lower than that applied to the transfer roller 6*a*. This regulation prevents a gradual increase in electric potential of the transfer/transport belt 7. In addition, the present embodiment requires neither complicated regulation of the transfer bias voltage nor a complex configuration.

Accordingly, the present embodiment allows stable application of the transfer bias voltage in the image forming stations 20, thereby preventing image quality deterioration at a front portion of a sheet. Moreover, the stable application of the transfer bias voltage prevents developer wastage and allows prolonged life of the transfer belt cleaning unit 9 provided for removing and capturing the developer. Besides, in the present embodiment, the surface of the image carriers is prevented from being irregularly charged. In addition, the present embodiment has a secondary advantage of reducing damage caused to the photosensitive drums 3 by contact with the transfer rollers 6 and of thus preventing deterioration of the photosensitive drums 3.

FIG. 7 is a table illustrating the relationship between (a) rotational speed and electric potential of the photosensitive drums 3 and (b) the non-transfer bias voltage. In the present embodiment, the non-transfer bias voltage to be applied to the transfer rollers 6 is regulated in accordance with the rotational speed and electric potential of the photosensitive drums 3.

More specifically, with the rotational speed of the photosensitive drums 3 high (117 mm/s), the non-transfer bias voltage applied to the transfer roller 6*a* is set at +300 V, independently of the surface potential of the photosensitive drums 3. When the rotational speed low (39 mm/s), the non-transfer bias voltage is set at +225 V.

With respect to the transfer rollers 6*b*, 6*c*, and 6*d*, the non-transfer bias voltage applied thereto is regulated within a range of +50 V to +200 V, in several phases according to the surface potential of the photosensitive drums 3, independently of the rotational speed of the photosensitive drums 3.

The higher the rotational speed of the photosensitive drums 3, the greater influence the surface potential of the photosensitive drums 3 has on the electric potential of the transfer rollers 6. Accordingly, it is necessary that rise in electric potential of the transfer rollers 6 occur promptly after the application of the transfer bias voltage. In the present embodiment, in view of the above, the higher the rotational speed of the photosensitive drums 3, the greater the non-transfer bias voltage to be applied to the transfer roller 6*a* becomes.

The non-transfer bias voltage may also be adjusted in accordance with temperature and relative humidity detected by the temperature/humidity sensor 22.

Figure 8:
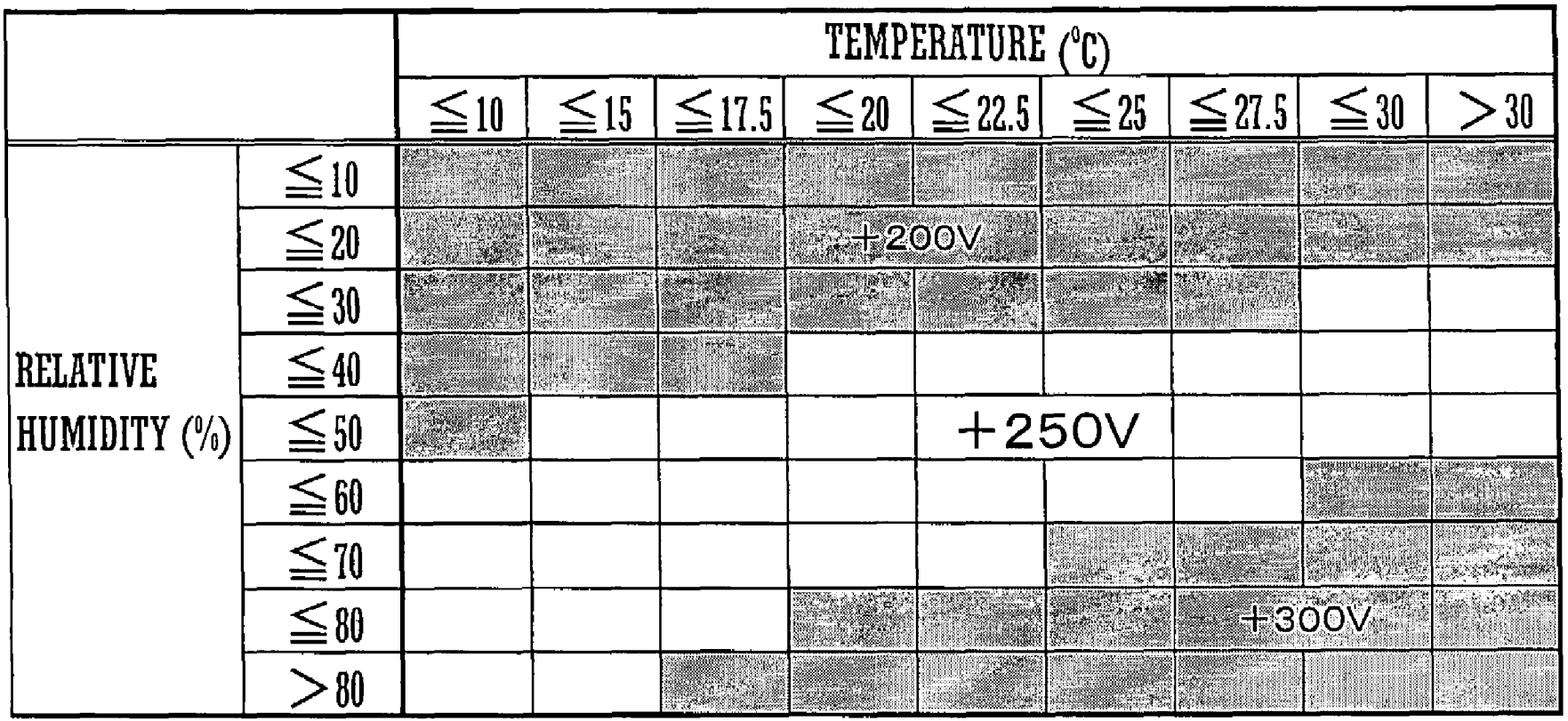
FIG. 8 is a table illustrating the relationship between temperature and humidity, and the non-transfer bias voltage.

FIG. 8 is a table illustrating the relationship between temperature, humidity, and the non-transfer bias voltage. Regulation of the non-transfer bias voltage according to this table allows setting of optimum non-transfer bias voltages under internal environmental conditions of the image forming apparatus 100.

Specifically, if the relative humidity is low, the non-transfer bias voltage may be about +200 V. If the temperature and relative humidity are high, the non-transfer bias voltage needs to be set higher because of an increased sheet resistance. Here, the non-transfer bias voltage is set at about +300 V. With the humidity at an intermediate level, the non-transfer bias voltage is set at about +250 V as an intermediate value.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

image forming stations arranged along a sheet transport path, each having an image carrier;

a transfer/transport belt for holding and transporting downstream in a sheet transport direction a sheet for an image to be formed thereon by the image forming stations;

transfer electrodes in contact through the transfer/transport belt with the image carriers provided in the image forming stations; and a voltage applying device for applying a voltage to the transfer electrodes, wherein the voltage applying device, when a transfer process is not performed, applies a non-transfer bias voltage to only the transfer electrode in contact with the image carrier, the non-transfer bias voltage having the same polarity as transfer bias voltage and being lower than a transfer bias voltage, wherein the voltage applying device applies a higher non-transfer bias voltage to a first transfer electrode positioned upstream with reference to the sheet transport direction than to the other transfer electrodes.

2. An image forming apparatus comprising:

image forming stations arranged along a sheet transport path, each having an image carrier;

a transfer/transport belt for holding and transporting downstream in a sheet transport direction a sheet for an image to be formed thereon by the image forming station;

transfer electrodes in contact through the transfer/transport belt with the image carriers provided in the image forming stations; and a voltage applying device for applying a voltage to the transfer electrodes, wherein the voltage applying device, when a transfer process is not performed, applies a non-transfer bias voltage to only the transfer electrode in contact with the image carrier, the non-transfer bias voltage having the same polarity as transfer bias voltage and being lower than a transfer bias voltage, wherein the non-transfer bias voltage is increased as an electric potential of the image carriers increases.

3. An image forming apparatus comprising:

image forming stations arranged along a sheet transport path, each having an image carrier;

a transfer/transport belt for holding and transporting downstream in a sheet transport direction a sheet for an image to be formed thereon by the image forming stations;

transfer electrodes in contact through the transfer/transport belt with the image carriers provided in the image forming stations; and a voltage applying device for applying a voltage to the transfer electrodes, wherein the voltage applying device, when a transfer process is not performed, applies a non-transfer bias voltage to only the transfer electrode in contact with the image carrier, the non-transfer bias voltage having the same polarity as transfer bias voltage and being lower than a transfer bias voltage, wherein the voltage applying device applies an increased non-transfer bias voltage to the transfer electrodes as rotational speed of the image carriers increases.

* * * * *